US007448853B2

(12) United States Patent
Mabe et al.

(10) Patent No.: US 7,448,853 B2
(45) Date of Patent: Nov. 11, 2008

(54) SYSTEM AND METHOD OF DETERMINING CENTRIFUGAL TURBOMACHINERY REMAINING LIFE

(75) Inventors: William J. Mabe, Thornton, CO (US); Harold H. Mays, Denver, CO (US)

(73) Assignee: Sundyne Corporation, Arvada, CO (US)

( * ) Notice: Subject to any disclaimer, the term of this patent is extended or adjusted under 35 U.S.C. 154(b) by 565 days.

(21) Appl. No.: 11/103,864

(22) Filed: Apr. 12, 2005

(65) Prior Publication Data

US 2006/0228214 A1 Oct. 12, 2006

(51) Int. Cl.
*F01D 25/00* (2006.01)

(52) U.S. Cl. ..... 416/1; 416/39; 416/44; 416/61

(58) Field of Classification Search ..... 416/1, 416/36, 38, 39, 44, 61; 415/17, 30, 47, 118; 73/116, 119 R
See application file for complete search history.

(56) References Cited

U.S. PATENT DOCUMENTS 3,584,507 A 6/1971 Hohenberg
3,950,985 A 4/1976 Buchwald et al.
4,046,002 A * 9/1977 Murphy et al. ..... 73/116
4,057,714 A 11/1977 Fork et al.
4,112,747 A 9/1978 Aldridge et al.
4,129,037 A 12/1978 Toalson
4,135,246 A 1/1979 McMannis
4,151,740 A 5/1979 Havstad
4,733,529 A 3/1988 Nelson et al.
4,796,465 A 1/1989 Carreno et al.
4,854,120 A 8/1989 Nelson et al.
4,908,775 A 3/1990 Palusamy et al.
4,954,974 A 9/1990 Howell, IV et al.
5,042,295 A 8/1991 Seeley
5,447,059 A 9/1995 Miller et al.
5,533,413 A 7/1996 Kobayashi et al.
5,654,500 A 8/1997 Herron et al.
5,680,310 A 10/1997 Morgan et al.
5,726,891 A 3/1998 Sisson et al.
5,913,184 A 6/1999 Girbig
6,209,390 B1 * 4/2001 LaRue et al. ..... 73/119 R
6,247,900 B1 6/2001 Archibald et al.
6,282,882 B1 9/2001 Dudd, Jr. et al.
6,343,251 B1 1/2002 Herron et al.
6,490,543 B1 12/2002 Jaw
6,506,010 B1 1/2003 Yeung et al.
6,523,999 B1 2/2003 Ishii et al.
6,526,356 B1 2/2003 DiMaggio et al.

(Continued)

*Primary Examiner*—Ninh H Nguyen
(74) *Attorney, Agent, or Firm*—Carlson, Gaskey & Olds

(57) ABSTRACT

A centrifugal turbomachine includes an impeller and a speed sensor arranged to detect a speed associated with an impeller speed. A temperature sensor is arranged to detect a temperature associated with an impeller exit temperature. A controls system has impeller parameters, which includes the impeller speed and exit temperature. A calculation methodology is used to mathematically manipulate the impeller parameters to determine a remaining life of the impeller. A program response, such as a warning indication, is triggered by the control system in response to the remaining life reaching a threshold. The controls system monitors the speed and temperature of the impeller. The controls system internally calculates the remaining life based upon the speed and the temperature. In one example, a change in remaining life is calculated in response to a change in speed that results in an impeller stress that exceeds an endurance strength for the impeller.

16 Claims, 3 Drawing Sheets

U.S. PATENT DOCUMENTS 6,711,952 B2 3/2004 Leamy et al.
6,719,526 B2 4/2004 Sanborn et al.
7,104,120 B2 * 9/2006 Gladden ..... 73/119 R
2003/0028332 A1 2/2003 DiMaggio et al.
2004/0060371 A1 4/2004 Barkhoudarian

* cited by examiner

SYSTEM AND METHOD OF DETERMINING CENTRIFUGAL TURBOMACHINERY REMAINING LIFE

BACKGROUND OF THE INVENTION

The present invention relates to a system and method of determining the remaining life of a centrifugal turbomachinery impeller. A centrifugal turbomachine may include one or more pump, turbine, or compressor impellers.

Centrifugal turbomachinery typically operate at high shaft speeds for best aerodynamic performance. At design speed the highest stresses approach yield strength of the materials typically used in this application, such as aluminum alloys. Generally, this can be accepted if the operating stress is steady, for example, fixed speed.

Turbomachinery equipment can be expected to operate either in a relatively steady mode at fixed speed or with variable speed. An example of a variable speed application is an air compressor that must produce a maximum pressure and then stop or return to idle mode at a lower speed to save energy. A typical idle speed is 30% of design speed where power is reduce to 3% of maximum power. The stresses in the impeller vary by the square of the speed.

When subjected to many start and stop cycles or random excursions in speed, the material can degrade and fail from fatigue. The life curve is a function of stress ratio, which is defined as the minimum stress divided by the maximum stress. Mean stress is the average of the maximum stress and the minimum stress. The amplitude for a given stress cycle is the maximum stress minus the minimum stress divided by two. The material strength also reduces with increasing temperature. If sufficient cycles are accumulated, the material cracks at the highest stress location and fails catastrophically due to the high mean stress from centrifugal loading. In practice, the speed can cycle from any minimum value to the maximum in a somewhat random nature depending upon the application. It is advantageous to predict with reasonable accuracy when the point of catastrophic failure may occur.

SUMMARY OF THE INVENTION

This invention relates to centrifugal turbomachinery including one or more impellers. A speed sensor is arranged to detect a speed associated with an impeller rotational speed. A temperature sensor is arranged to detect a temperature associated with an impeller exit temperature. A controls system has impeller parameters, which include the impeller speed and exit temperature. A calculation methodology is used to mathematically manipulate the impeller parameters to determine a remaining life of the impeller. A programmed response, such as a warning indication, is triggered by the control system in response to the remaining life reaching a threshold.

In operation, the controls system monitors the speed and temperature of the impeller. The controls system iteratively calculates the remaining life based upon the speed and the temperature. In one example, a change in remaining life is calculated in response to a change in speed that results in an impeller stress that exceeds the endurance strength for the impeller.

These and other features of the present invention can be best understood from the following specification and drawings, the following of which is a brief description.

DETAILED DESCRIPTION OF THE PREFERRED EMBODIMENT

Figure 1:
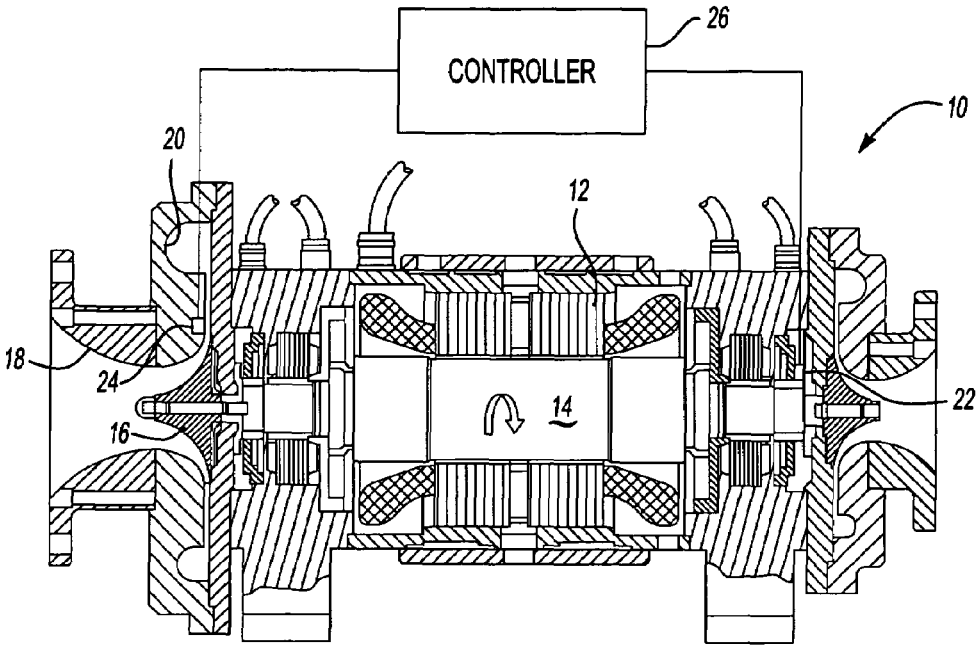
FIG. 1 is a cross-sectional view of a centrifugal turbomachine having the inventive remaining life controls systems.

A centrifugal turbomachine 10 is shown schematically in FIG. 1. The turbomachine 10 includes a stator 12 driving a rotor shaft 14, as is well known in the art. An impeller 16 is mounted on the shaft 14. The impeller 16 transfers a fluid from an inlet 18 to an outlet 20.

The inventive centrifugal turbomachine 10 includes a speed sensor 22 for detecting a speed of the impeller 16. The speed sensor 22 either directly or indirectly detects the rotational speed of the impeller 16. A temperature sensor 24 is arranged to detect an exit temperature associated with the impeller 16. In the example shown, the temperature sensor 24 is arranged near an exit of the impeller 16.

A controls system includes a controller 26 communicating with the speed sensor 22 and temperature sensor 24. The controller 26 may communicate with other transducers. Additionally, the controller 26 may receive and store other impeller parameters, such as those relating to material properties of the impeller and stress characteristics of the impeller. The stress characteristics may be provided as an output from a finite element analysis model of the impeller 16 and/or tables.

Stress characteristics may include maximum impeller stress as a function of speed, fatigue strength as a function of temperature, stress ratio, cycles to fatigue failure, and fatigue strength modification factors. The stress characteristics may be provided as part of a lookup table or any other suitable means, as is well known in the art. Fatigue strength modification factors may include information relating to the surface finish of the impeller, size of particular features of the impeller, load on particular areas of the impeller and temperature of the impeller. The impeller parameters may be determined empirically or mathematically.

Figure 2:
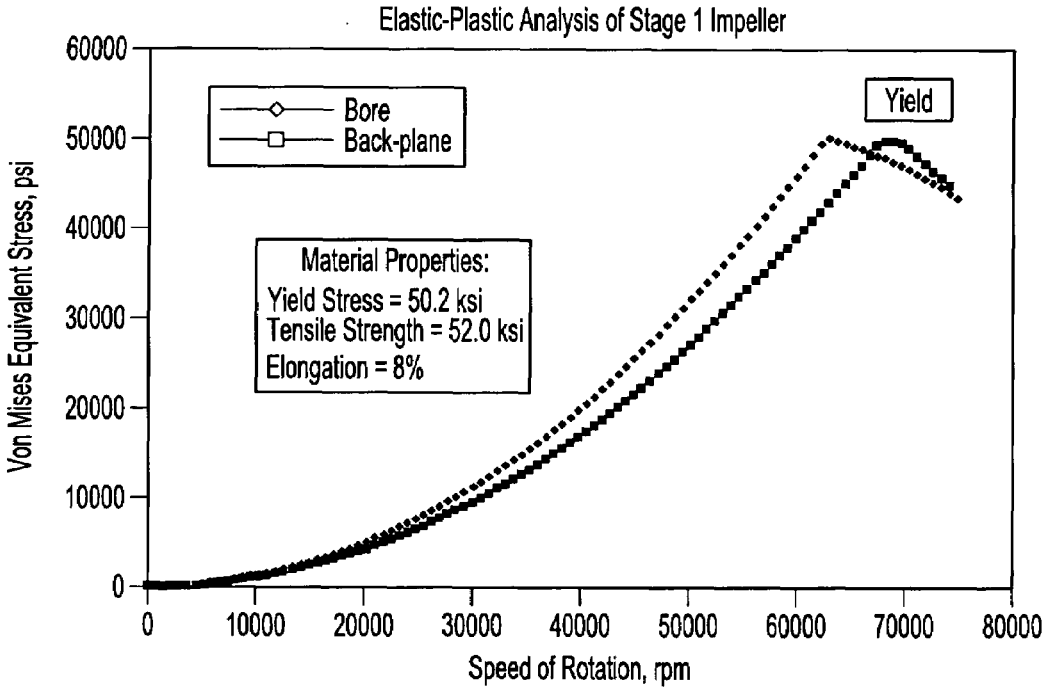
FIG. 2 is a graph depicting a maximum impeller stress obtained from finite element analysis as a function of impeller speed.

For the example centrifugal turbomachine shown in FIG. 1, the design speed is 58,000 rpm. The high speeds result in impeller stresses near yield at the maximum operating conditions. Stress as a function of speed is shown in FIG. 2 up to the point of excessive yield. As one can see from the analysis, which is of an aluminum alloy, the highest stresses approach the yield strength.

Figure 3:
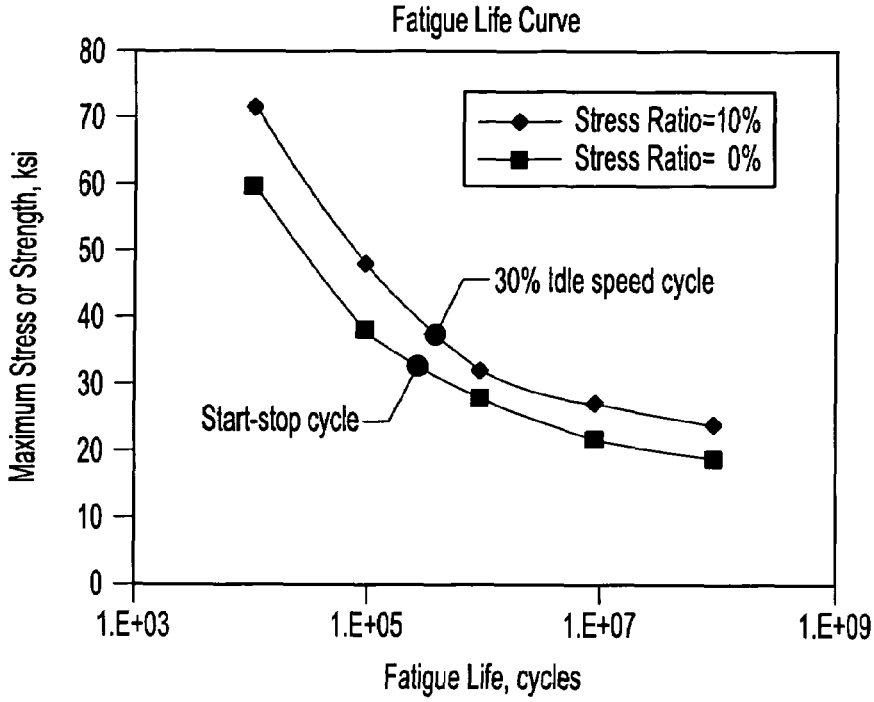
FIG. 3 is a graph of the fatigue stress of the impeller material relative to the fatigue life as a function of temperature and stress ratio.
Figure 4:
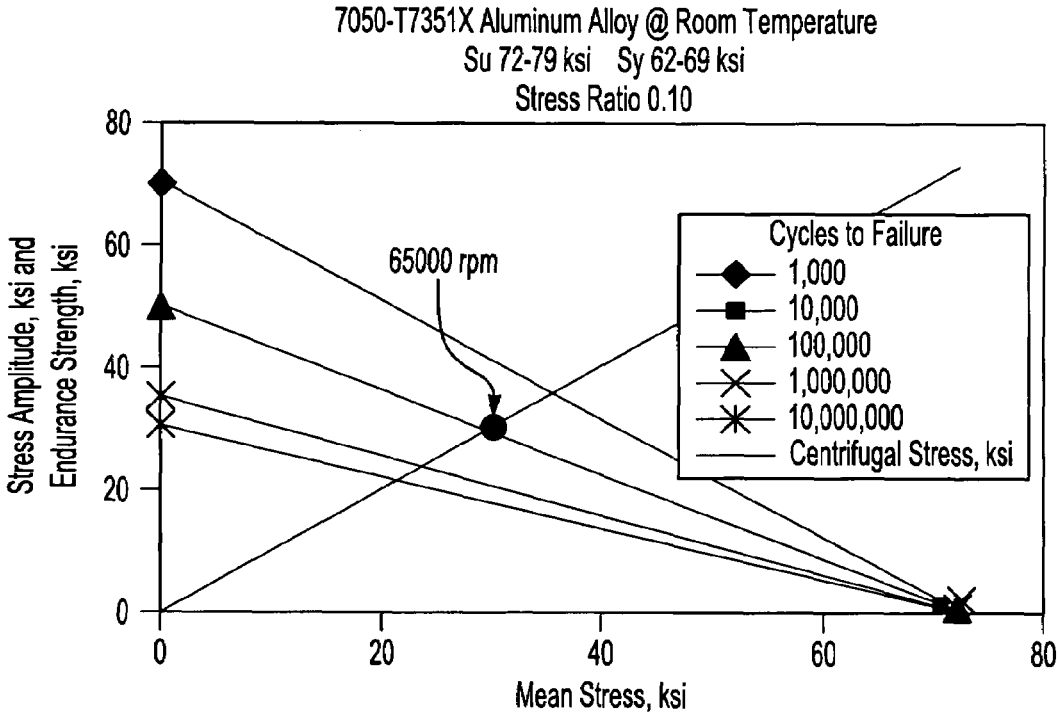
FIG. 4 is a life calculation depicted as a modified Goodman diagram.

The loss of strength of a common aluminum alloy as a function of fluctuating stress and fatigue life cycles is shown in FIG. 3 for a given temperature. A life calculation is generally shown on a modified Goodman diagram, seen in FIG. 4. With this analysis, given the minimum-maximum operating speeds and temperature, it is possible to estimate the number of stress cycles or allowable operating hours, given the number of start-stop cycles/hour, that an impeller can endure before failing. The present invention is useful for accounting for a reduction in life due to arbitrary speed excursions of the impeller. Various calculation methodologies may be used. For example, the calculations may be based upon the Palmgren-Miner cycle-ratio summation method or Manson's approach. These methodologies are well known in the art.

The parameters that are desirable to continuously monitor are the impeller speed and impeller exit temperature. The maximum impeller stress is determined from finite element analysis, for example, as a function of speed, which is indicated in FIG. 2. The material properties of the impeller are used, in particular, the fatigue stress as a function of temperature, stress ratio, and cycles to failure, as shown in FIG. 3. Referring to FIG. 3, the stress ratio 0% represents a start-stop cycle whereas 10% represents as example of a speed excursion to 30% of design speed. FIG. 3 indicates the corresponding available material strength and cycles to failure.

The monitored data, and impeller stress characteristics, material properties and calculating methodology may be programmed into the controller 26 and included as part of the controls system for the centrifugal turbomachine 10. In one example, the results of the calculations are used to trigger a warning indication such as a visual or audio alarm if the accumulated cycles approach the alarm limit or the number of allowable cycles prior to failure. Allowable cycles are typically established using a desired safety factor suitable for the particular application.

An alarm warning can be set at less than the alarm limit, such as a percent. Upon reaching the warning threshold, the control system can prevent speed excursions until the unit can be scheduled for shutdown and impeller replacement. This approach is taken because preventing speed excursions prevents accumulative damage to the impeller.

Upon reaching the alarm limit, the unit is shut down for impeller replacement. Alternatively, the unit may be allowed to operate continuously at full speed to avoid any fluctuating stresses until shutdown can be conveniently scheduled. In this manner, the customer can be forewarned to replace the impeller before actual failure.

Figure 5:
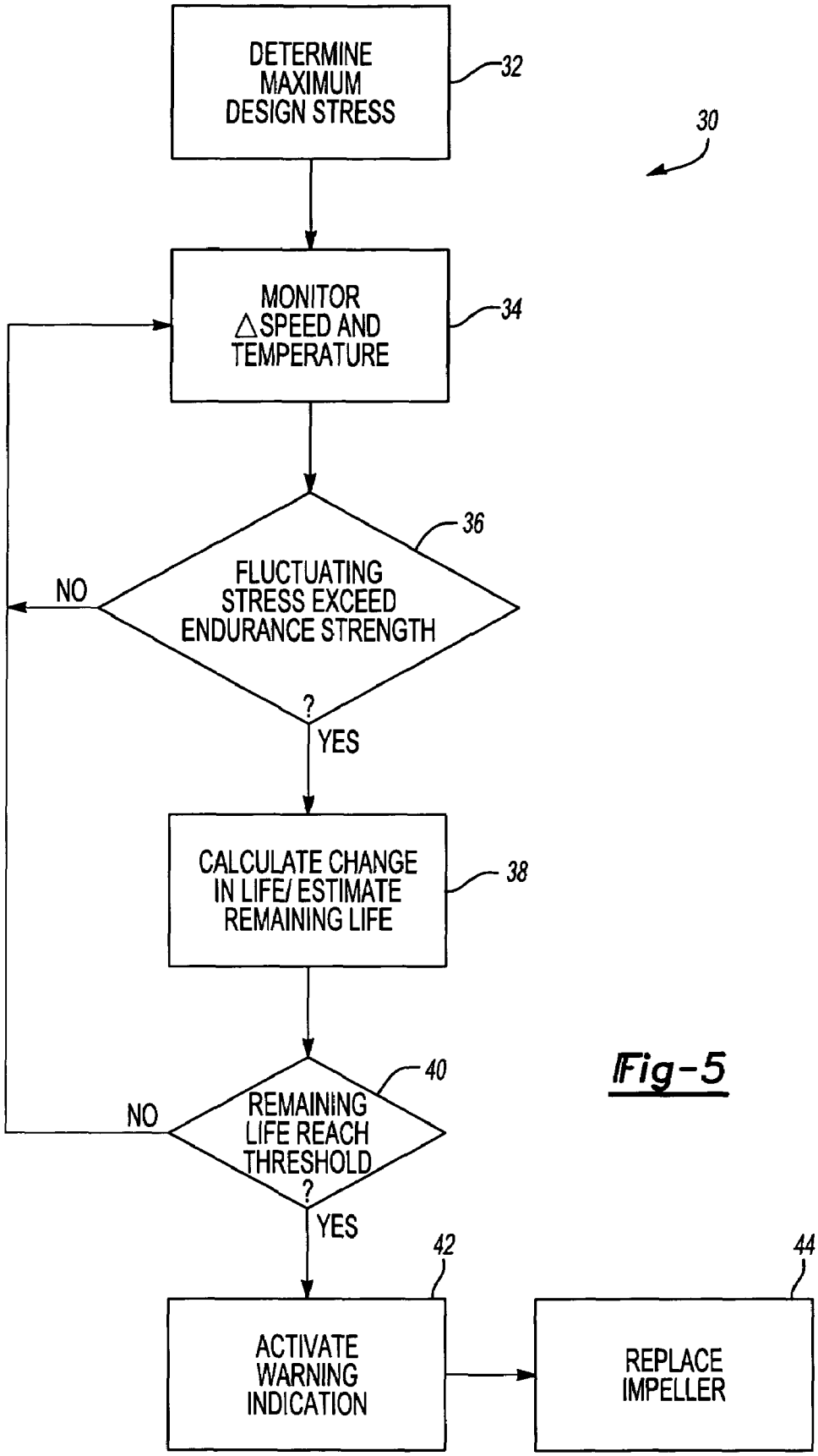
FIG. 5 is a flowchart generally depicting the inventive methodology for determining remaining life of the impeller.

In operation, a methodology similar to the example shown in FIG. 5 may be used to determine remaining impeller life. The method 30 includes the step of determining a maximum design stress for an impeller, shown at block 32. The maximum design stress may be provided using finite element analysis. The impeller speed and temperature are monitored using the sensors 22 and 24, as indicated at block 34. The change in speed and average temperature are calculated. Start-stop cycles and arbitrary speed excursions result in changes in speed that negatively impact the fatigue life of the impeller. The inventive method quantifies the reduction in fatigue life caused by changes in speed.

The resulting stress for a change in speed is calculated at block 36 to determine whether the stress exceeds the endurance strength for infinite life of the impeller. If the stress exceeds the endurance strength, then the reduction in life of the impeller is calculated, as indicated at block 38. In one example calculation methodology, the number of cycles ($N_f$) corresponding to the stress cycle produced by the change in speed is calculated. $N_f$ will be a function of the maximum speed, $N_1$, and the stress ratio, $r_S$.

$$N_{ref} = 63000$$

$$\sigma_{ref} = 49.4$$

$$S_{corr} = \sigma_{ref}\left(\frac{N_1}{N_{ref}}\right)^2$$

$$S_{\max} = \frac{S_{corr}}{CF} \quad \text{where } CF = k_a k_b k_c k_d \text{[Marin fatigue modifiers]}$$

$$S_{eq} = S_{\max}(1 - r_S)^{0.55}$$

$$\mathrm{Log}(N_f) = 10.5 - 3.79\mathrm{Log}(S_{eq} - 16)$$

Note that $N_f$ is a function of the stress ratio, $r_s$.

$$r_s = \text{min stress} \div \text{max stress}$$

Or, given that stress varies as the square of speed:

$$r_s = (N_2 \div N_1)^2$$

If speed of rotation is being monitored over time, the accumulation of stress cycles can be counted and an estimate made of the remaining life, as indicated at block 38. For example, starting with an initial value for the life variable, L=0, for each stress cycle:

$$\text{Find } N_f(N_1, r_S)$$

$$\Delta L = \frac{1}{N_f}$$

$$L = L + \Delta L$$

$$\text{Limit } L < 1.0$$

At any point in time, L is the portion of the expected life logged by the impeller.

In one example, a typical day's operation consist of ramping from rest to a maximum speed of 60000 rpm, shuttling between that maximum and a minimum speed of 20000 rpm four times total and returning to rest. The temperature starts at ambient and rises to a maximum of 300 degrees F. The fatigue strength modification factors are:

Surface, $K_a$=0.900 (machined surface)

Size, $K_b$=0.856 (diameter=1.181 inch)

Load, $K_c$=1.0

Temperature, $K_d$=1.098−1.25116*T(° F.), Aluminum alloy 7050-T351

[where $K_d = S_T/S_{RT}$, and $S_T$=strength at operating temperature, T $S_{RT}$=strength at room temperature]

The table below shows the results of the life calculations.

| Cycle | $N_1$ rpm | $N_2$ rpm | $r_s$ | Temp deg F. | CF | $S_{corr}$ ksi | $S_{max}$ ksi | $S_{eq}$ ksi | $N_f$ | ΔL days | L days |
|---|---|---|---|---|---|---|---|---|---|---|---|
| 1 | 60000 | 20000 | 0.1 | 150 | 0.70 | 44.8 | 63.8 | 60.2 | 18305 | 0.000055 | 0.000055 |
| 2 | 60000 | 20000 | 0.1 | 225 | 0.63 | 44.8 | 71.2 | 67.2 | 10553 | 0.000095 | 0.000149 |
| 3 | 60000 | 20000 | 0.1 | 300 | 0.56 | 44.8 | 80.4 | 75.9 | 5813 | 0.000172 | 0.000321 |
| 4 | 60000 | 20000 | 0.1 | 300 | 0.56 | 44.8 | 80.4 | 75.9 | 5813 | 0.000172 | 0.000493 |
| 5 | 60000 | 0 | 0 | 300 | 0.56 | 44.8 | 80.4 | 80.4 | 4410 | 0.000227 | 0.000720 |

At the end of the day, the accumulative L value says that 0.072% of the expected life has been used up and if typical, another 1/0.000720=1389 days=3.8 years might be expected.

When the remaining life reaches a threshold, the controller 26 may activate a warning indication, which may include a visual and/or audible warning, as indicated in block 42. Alternatively, the remaining life may simply be stored or displayed in an accessible manner to be checked periodically by service personnel. The service personnel may then replace the impeller before failure, as indicated at block 44. The method 30 is iteratively repeated to calculate subsequent reductions in life of the impeller due to changes in speed.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbomachine comprising:

an impeller;

a speed sensor arranged to detect a speed associated with an impeller speed;

a temperature sensor arranged to detect a temperature associated with an impeller exit temperature;

a controls system having impeller parameters including impeller speed and exit temperature, a calculation methodology mathematically manipulating the impeller parameters to determine a remaining life of the impeller, and a programmed response triggered by the controls system in response to the remaining life reaching a threshold; and wherein the impeller parameters include stress characteristics of the impeller having fatigue strength modification factors including at least one of impeller surface finish, load on an impeller area, and size of an impeller feature.

2. The centrifugal turbomachine according to claim 1, wherein said speed sensor detects a speed of a shaft supporting the impeller.

3. The centrifugal turbomachine according to claim 1, wherein the temperature sensor is arranged near an impeller exit.

4. The centrifugal turbomachine according to claim 1, wherein the calculation methodology is based upon Palmgren-Miner cycle-ratio summation.

5. The centrifugal turbomachine according to claim 1, wherein the calculation methodology is based upon Manson's approach.

6. The centrifugal turbomachine according to claim 1, wherein the impeller parameters include material properties of the impeller.

7. The centrifugal turbomachine according to claim 1, wherein the stress characteristics include at least one of maximum impeller stress as a function of speed, fatigue strength as a function of temperature, stress ratio, and cycles to failure relative to maximum stress.

8. The centrifugal turbomachine according to claim 1, wherein the programmed response is a warning indication.

9. A method of calculating impeller remaining life comprising the steps of:

a) monitoring a speed of an impeller;

b) monitoring a temperature associated with the impeller;

c) iteratively calculating a remaining life of the impeller based upon a change in the speed and the temperature;

d) producing a warning indication when the remaining life reaches a threshold; and e) avoiding an undesired change in speed when the remaining life reaches the threshold.

10. The method according to claim 9, wherein step c) includes iteratively calculating remaining life at a rate corresponding a stress cycle produced by the change in speed.

11. The method according to claim 10, wherein step c) includes calculating a change in life attributable to the change in speed.

12. The method according to claim 9, wherein step c) is based upon calculating the remaining life as a function of a stress ratio.

13. The method according to claim 9, wherein step c) uses a maximum design stress of the impeller.

14. A turbomachine comprising:

an impeller;

a speed sensor arranged to detect a speed associated with an impeller speed;

a temperature sensor arranged to detect a temperature associated with an impeller exit temperature; and a controls system having impeller parameters including impeller speed and exit temperature, a calculation methodology mathematically manipulating the impeller parameters to determine a remaining life of the impeller based upon changes in the impeller speed, and a programmed response triggered by the controls system in response to the remaining life reaching a threshold, the programmed response including avoidance of undesired changes in the impeller speed.

15. The turbomachine according to claim 14, wherein the avoidance of undesired changes in the impeller speed includes operating the impeller at a fixed speed.

16. The turbomachine according to claim 15, wherein the fixed speed includes a full speed condition.

* * * * *